US007240896B1

(12) United States Patent
Gliniecki et al.

(10) Patent No.: US 7,240,896 B1
(45) Date of Patent: Jul. 10, 2007

(54) CARBURETOR FUEL ADJUSTMENT ASSEMBLY

(75) Inventors: Gary U. Gliniecki, Ruth, MI (US); Larry D. Whittaker, Cass City, MI (US); Eric G. Zbytowski, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/122,499

(22) Filed: May 5, 2005

(51) Int. Cl.
*F02M 3/08* (2006.01)

(52) U.S. Cl. ..... 261/71; 261/DIG. 38; 261/DIG. 84

(58) Field of Classification Search ..... 261/71, 261/DIG. 38, DIG. 84; 137/382, 382.5; 411/301, 412, 542
See application file for complete search history.

(56) References Cited

U.S. PATENT DOCUMENTS

| | | | | |
|---|---|---|---|---|
| 3,321,195 | A * | 5/1967 | Korte | 261/41.5 |
| 3,469,825 | A | 9/1969 | Du Bois | 261/71 |
| 4,283,353 | A | 8/1981 | Miller | 261/41.5 |
| 5,236,634 | A | 8/1993 | Hammett et al. | 261/71 |
| 5,249,773 | A * | 10/1993 | Feld | 251/129.11 |
| 5,252,261 | A * | 10/1993 | Gerhardy | 261/71 |
| 5,667,734 | A | 9/1997 | Ohgane | 261/71 |
| 5,707,561 | A | 1/1998 | Swanson | 261/71 |
| 5,753,148 | A | 5/1998 | King et al. | 261/71 |
| 5,948,325 | A | 9/1999 | Yanaka | 261/71 |
| 6,302,384 | B1 | 10/2001 | Douyama | 261/71 |
| 6,402,124 | B1 | 6/2002 | Pattullo et al. | 261/71 |
| 6,402,125 | B1 | 6/2002 | Burns et al. | 261/71 |
| 6,540,212 | B2 | 4/2003 | Burns et al. | 261/71 |
| 7,070,173 | B2 * | 7/2006 | Dow et al. | 261/44.6 |
| 2001/0026025 | A1 * | 10/2001 | Nagata et al. | 261/71 |

FOREIGN PATENT DOCUMENTS

| | | | | |
|---|---|---|---|---|
| JP | 55-104556 | * | 8/1980 | 261/DIG. 38 |

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor fuel adjustment assembly includes a low speed needle valve and preferably a high speed needle valve threaded into respective receptacles of a carburetor body. Each receptacle defines an elongated cavity which intersects a fuel passage and has a valve orifice or seat. Each needle valve has a shank which threadably engages the respective receptacles and a tip that extends into the axially-aligned orifice or seat. The tip is axially movable relative to the orifice by rotation of the needle valve to control the size of the opening between the valve and orifice for fuel flow. A resilient body cooperates with the valve shank in laterally biasing the tip into a steadfast position relative to the orifice or seat. The lateral bias assures constant area for fuel flow through the orifice by resisting needle movement until a sufficient torque is intentionally applied to the needle valve.

26 Claims, 5 Drawing Sheets

CARBURETOR FUEL ADJUSTMENT ASSEMBLY

FIELD OF THE INVENTION

This invention relates generally to a carburetor and more particularly to a fuel flow adjustment assembly of a carburetor for a combustion engine.

BACKGROUND OF THE INVENTION

As shown in FIGS. 1 and 2, a known prior art carburetor has a fuel adjustment assembly 16 with low and high speed adjustable needle valves 17, each threaded into a needle valve receptacle 18 in a carburetor body 19. To permit adjustment of fuel flow, each valve receptacle 18 communicates with a separate fuel passage (not shown) in the carburetor body. Each needle valve 17 generally includes a distal tip 21, an enlarged head 22 and a threaded shank 23 disposed between the tip and the enlarged head. The threaded shank 23 of the needle valve 17 engages a female threaded portion 20 of the needle valve receptacle 18. The tip 21 of the valve 17 may be positioned within an axially-aligned needle seat orifice of the fuel passage and can be axially advanced and retracted, by rotation of the needle valve 17, to adjust the fuel flow rate. Axial advancement and retraction of the distal tip 21 in the seat orifice respectively decreases and increases the amount of fuel that can flow through the orifice by decreasing and increasing the cross-sectional area through which fuel flows. The enlarged head 22 of the needle valve 17 is rotated by using a tool such as a screwdriver inserted into a diametric slot 24 in the head 22 which protrudes from the carburetor body 19. In some such assemblies, to prevent inadvertent or un-commanded rotation of the needle valve 17, an adjustment needle limiter cap 25 is placed over the screw head 22 and is engagable with an adjacent stop.

Because of machining tolerances and limitations during manufacture, fuel adjustment assemblies of this type include enough clearance between the threads of shank 23 of the needle valve 17 and the valve receptacle 18 to allow for lateral and axial movement of the tip 21 relative to the needle seat orifice when force is applied to the valve head 22. This lateral and axial movement can change the size of the orifice flow area enough to result in fuel flow rate changes of up to 20% from an optimum fuel flow rate determined by the manufacturer. Fuel flow rate changes caused by this needle "slop or wobble" result in excessively rich or lean fuel mixtures that undesirably increase exhaust emissions or affect engine performance. Therefore, it is desirable to reduce fuel flow fluctuations through the needle valve 17 and the resulting increase in exhaust emissions and/or deterioration of engine performance by limiting needle slop and wobble.

Not only is it desirable to limit or hold steady the lateral and axial position of the needle valve tip 21 with respect to the orifice and regardless of the valve's rotational position, it is also desirable to maintain the desired setting of the fuel flow in a running engine. Any inadvertent rotation of the needle valve 17, possibly caused by the vibration of a running engine or placement of a conventional limiter cap 25 over the valve's head 22 and after valve adjustments, can alter desired setting of the fuel flow. Therefore it is desirable to restrain the rotation of the needle valve 17 thereby preventing any unintended changes to the fuel flow setting. To do so, traditionally, compression springs 26 are disposed concentrically about the shank 23 and axially between the carburetor body 19 and the head 22 of the needle valve 17. The spring-induced axial force produces increased frictional forces amongst the threads between the carburetor body 19 and the needle valve 17, thus resisting needle valve rotation and alteration of the fuel flow setting. Unfortunately, springs 26 are relatively expensive to manufacture, and to produce sufficient frictional forces must be relatively long, causing the needle valves 17 to project a substantial distance outward from an otherwise compact carburetor.

One example of a stabilizing system for a fuel adjustment assembly is disclosed in U.S. Pat. No. 6,540,212, issued Apr. 1, 2003, assigned to Walbro Corporation, and incorporated herein by reference. This U.S. patent generally describes the carburetor fuel adjustment assembly 16 illustrated in FIGS. 1 and 2, having both the spring 26, as described above, and a retainer or clip 27 which exerts a lateral force upon the spring 26 and indirectly upon the needle valve shank 23 to produce further friction and minimize unintentional valve rotation. Unfortunately, the retainer clip 27 is external to the carburetor body 19 and thus subject to possible damage.

Another example of a stabilizing system for a fuel adjustment assembly is disclosed in U.S. Pat. No. 5,948,325, issued Sep. 7, 1999, assigned to U.S.A. Zama, Incorporated, and incorporated herein by reference. In this U.S. patent, a resilient fastening member is press fitted into a pre-drilled bore of a carburetor body. Once located in the bore, two needle valve receptacle cavities are bored transversely into the body and completely through the fastening member, thus the fastening member has a diameter which is larger than the receptacle cavity. Threads are then formed in the receptacles by rolling threads into both the carburetor body and the fastening member, for threadable receipt of the needle valves. Because the fastening member is resilient, it does not undergo plastic deformation during thread rolling and does not form actual female threads as does the metal portion of the receptacle or carburetor body. When the needle valves are installed and adjusted, the fastening member produces a frictional force upon the male threaded valve shanks which assuredly holds the valves in their adjusted position. Unfortunately, manufacture of the fastening member is expensive because after installation into the carburetor body, it must be drilled to produce two axially spaced through-holes and the threads must be formed by the thread rolling. Moreover, the process of manufacturing the carburetor is restricted because both the receptacles and the fastening member must be machined simultaneously. Yet further, the bore required to receive the fastening member is relatively long because the through-holes, and thus the receptacles, are spaced radically away from one-another and with respect to the longitude of the bore. This requires a large portion of the carburetor body to be dedicated for the bore and fastening members, and which might otherwise be utilized for other carburetor features, producing a relatively larger and less compact carburetor.

SUMMARY OF THE INVENTION

A carburetor fuel adjustment assembly includes one and preferably two needle valves threaded into respective receptacles of a carburetor body and engaged with a retainer of resilient material. Each receptacle defines an elongated cavity which intersects a fuel passage. Each needle valve has a shank which threadably engages its associated receptacle and a tip axially movable relative to an orifice or seat by rotation of the shank to control fuel flow. The resilient retainer body frictionally engages and laterally biases the needle valve into a steadfast position relative to the orifice or seat. This assures the adjusted or set fuel flow does not change by resisting unintended needle valve movement due to such factors as engine vibration and factory installation of limiter caps, and until an intentional and sufficient torque is applied to the needle valve to change its setting or adjusted position.

The resilient retainer may be in the form of a plug or sleeve and preferably, is inserted into a bore after the receptacles are machined. Preferably the bore extends between and is preferably transverse to a pair of receptacles and in part opens into the receptacles. In this way, a portion of the plug or sleeve is exposed in each receptacle with a convex or cylindrical shape. Because such exposures are preferably substantially equal, the torque required to rotate each of the needle valves are substantially the same for both needle valves.

Objects, features and advantages of this invention include a carburetor fuel flow adjustment assembly which prevents inadvertent alteration of fuel flow after calibration, after factory installation of limiter caps and/or during user operation, improves engine control, improves engine performance and useful life, provides a compact carburetor design, reduces manufacturing costs and assembly costs, is relatively simple design, robust, inexpensive, requires little to no maintenance and in service has a long useful life.

BRIEF DESCRIPTION OF THE DRAWINGS

These and other objects, features and advantages of the invention will become apparent from the following detailed description of the preferred embodiment(s) and best mode, appended claims, and accompanying drawings in which:

DETAILED DESCRIPTION

Figure 6:
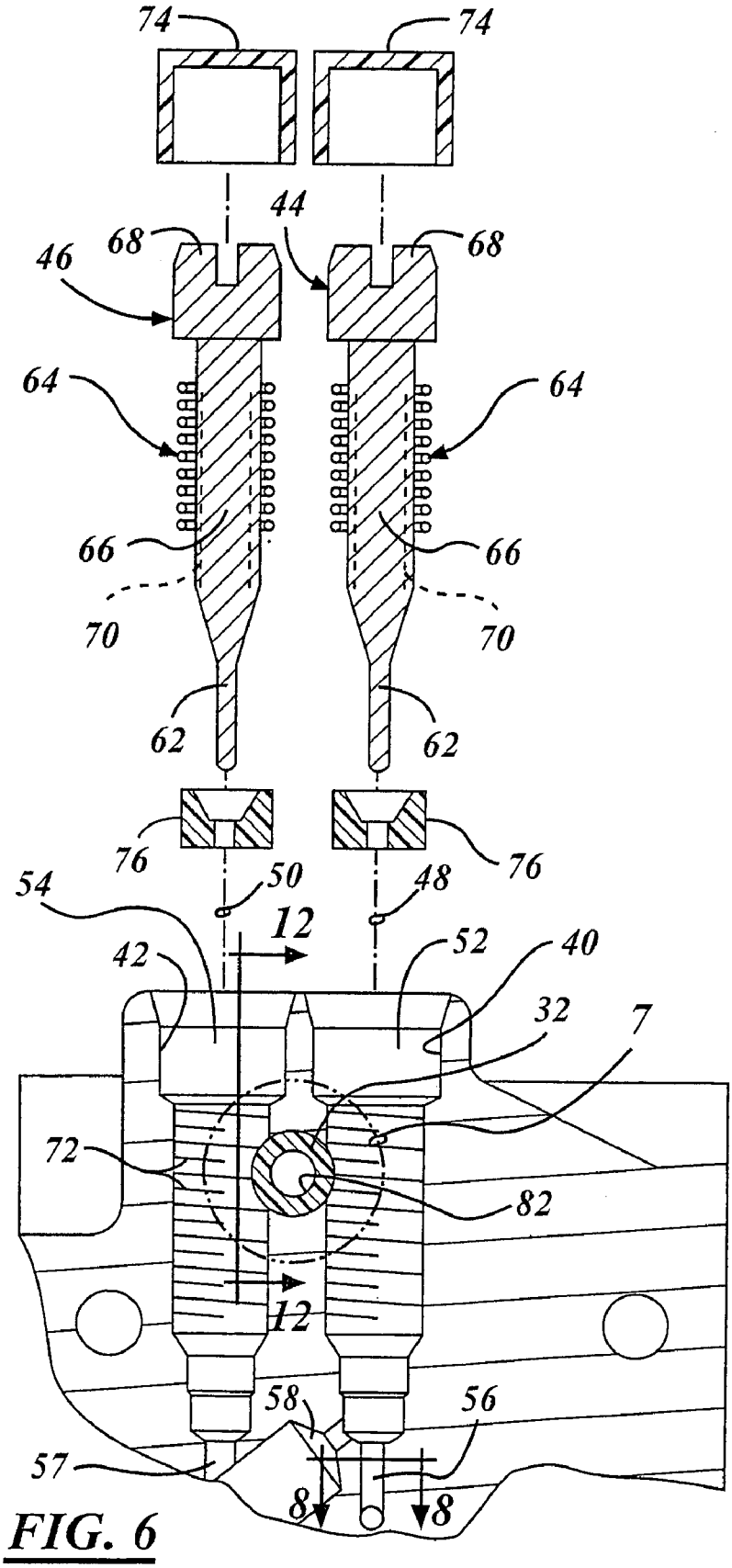
FIG. 6 is an enlarged partial and exploded cross section of the carburetor taken generally along line 6—6 of FIG. 3.

Referring in more detail to the drawings, FIGS. 3–6 illustrate a carburetor with an adjustable needle valve and retainer assembly 30, embodying the present invention. The fuel adjustment or needle valve assembly 30 controls fuel flow in a carburetor 34 for a combustion engine which is typically a gasoline powered two or four stroke spark ignition internal combustion engine. The carburetor 34 has a fuel-and-air mixing passage 36 through a carburetor body 38 and individually adjustable low and high speed needle valves 44, 46 each received in an associated receptacle 40, 42 in the carburetor body. The valves are threadably received in separate associated cavities 52, 54 each of which communicates with a separate coaxial fuel orifice or seat 56, 57 each disposed in a separate fuel passage 58 which communicates with the fuel-and-air mixing passage 36 to deliver fuel to the mixing passage. In operation liquid fuel is supplied to each cavity 52, 54 upstream of its orifice 56, 57 from a fuel reservoir or fuel metering chamber 60 through a passage such as passage 58 which is shown only for valve 44 and its associated cavity 52 and orifice 56. A similar fuel supply passage communicates with cavity 54 upstream of its orifice or seat 57. As shown in FIG. 6 each needle valve 44, 46 has a shank 66 with male threads 70 which in assembly are threadably received in mating complimentary female threads 72 in each cavity 52, 54. Each valve 44, 46 has a reduced diameter and preferably tapered tip 62 at one end which in assembly is received in part in its associated orifice 56, 57 and at the other end a head 68 the slot 69 therein for receiving the blade of a screwdriver to rotate the valve. In use, fuel flow is adjusted by rotating each valve in one direction to advance its tip 62 toward or further into its associated orifice or seat, 56, 57 to reduce fuel flow through its cavity, 52, 54 to the mixing passage 36 and rotated in the opposite direction to retract or withdraw its tip from its associated orifice 56, 57 to increase fuel flow through its cavity to the mixing passage.

The low and high-speed needle valves 44, 46 each preferably have a supplemental compression spring 64 which provides resistance against unintentional rotation of the needle valves 44, 46. The supplemental spring 64 generally concentrically encircles the shank 66 of the needle valve 44, 46 and is compressed axially between the radially enlarged head 68 of the needle valve 44, 46 and the carburetor body 38. The axial force produced by the compression springs 64 provides resistance which restrains rotation of the needle valves 44, 46 by indirectly creating friction between the male and female threads 70, 72 of the shanks 66 and the receptacles 40, 42 within the cavities 52, 54. In contrast, the resilient retainer 32 adds to this resistance by creating friction directly between itself and preferably the male threads 70 of the shank 66 and laterally urging the threads 70 into engagement with the female threads 72 in the carburetor body 34. Without use of the retainer plug 32, the size of the compression spring would be considerably larger to create the same frictional force. In many applications, elimination of the spring may be preferred. Preferably, a resilient annular seal 76 is fitted sealably between the needle 62 and the respective receptacles 40, 42 in a counter bore 78 of the cavity 52, 54.

Figure 1:
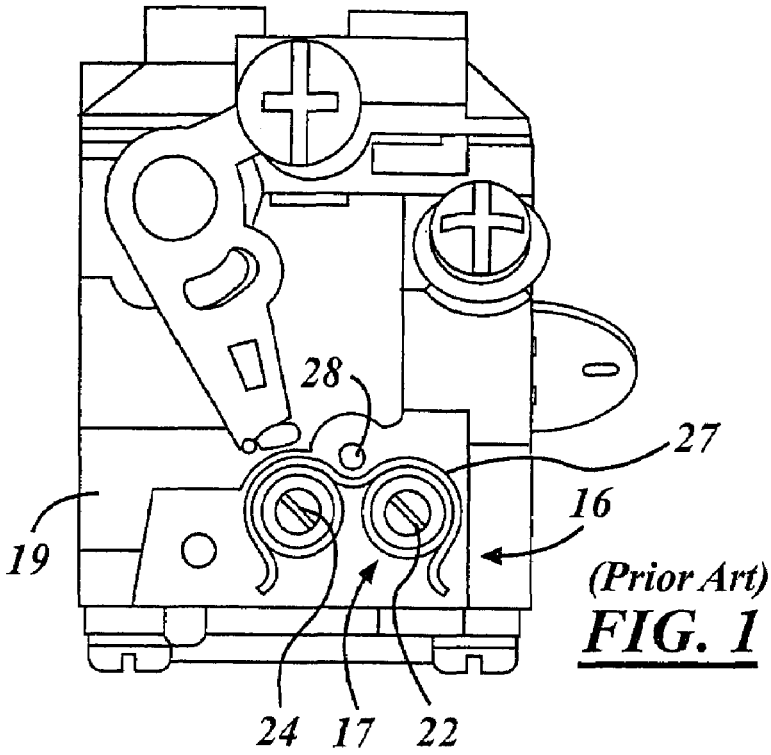
(Prior Art) FIG. 1
FIG. 1 is a side view of a prior art carburetor.
Figure 3:
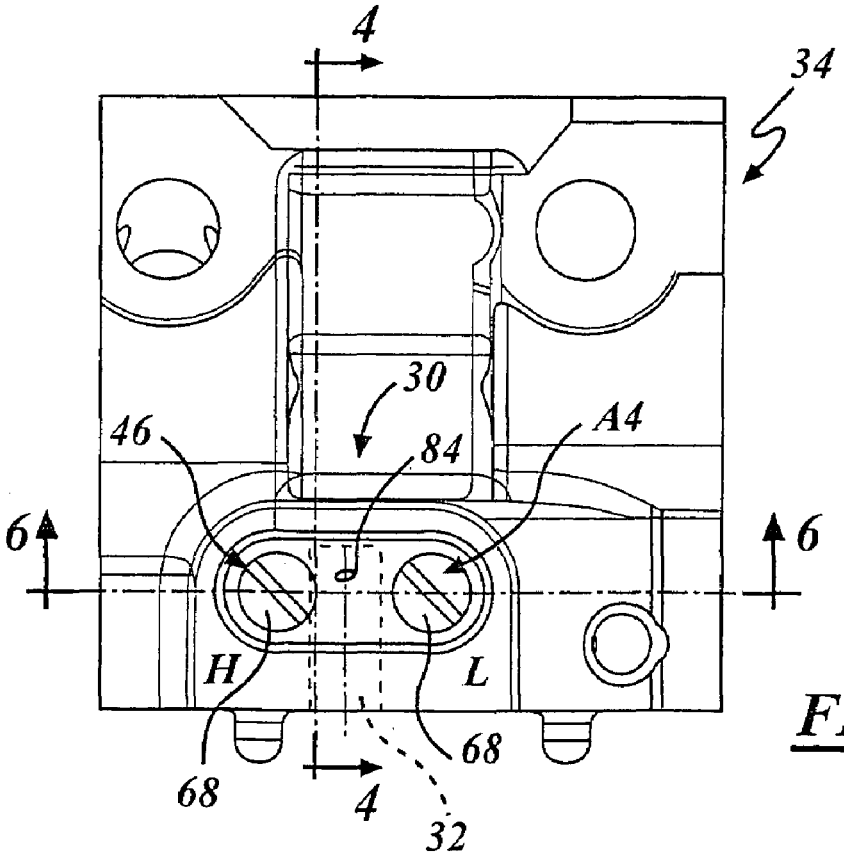
FIG. 3 is a side view of a carburetor having a fuel adjustment assembly of the present invention with limiter caps removed to show internal detail.
Figure 2:
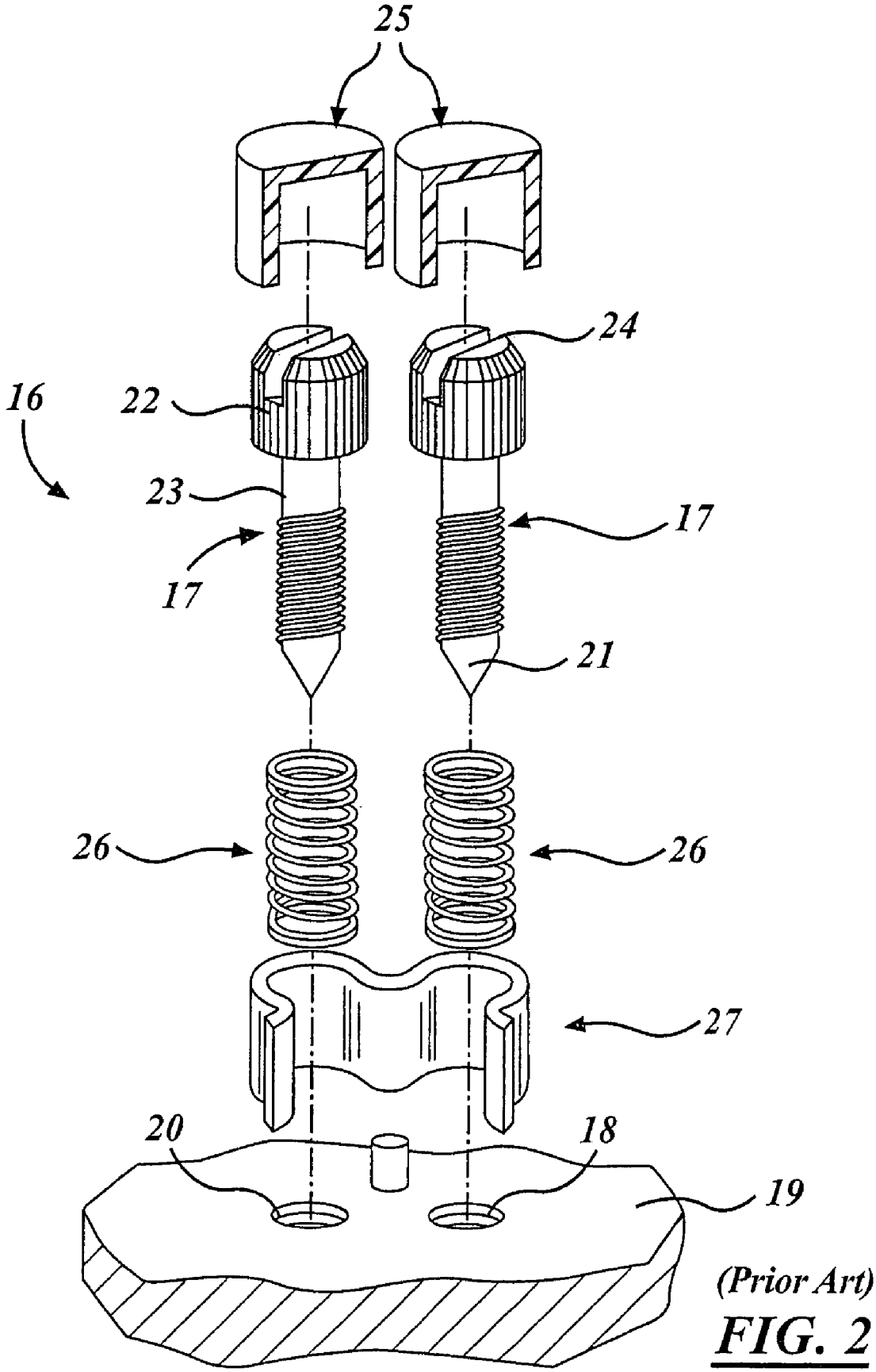
(Prior Art) FIG. 2
FIG. 2 is an exploded perspective view of a prior art mixture adjustment assembly of the carburetor of FIG. 1.
Figure 4:
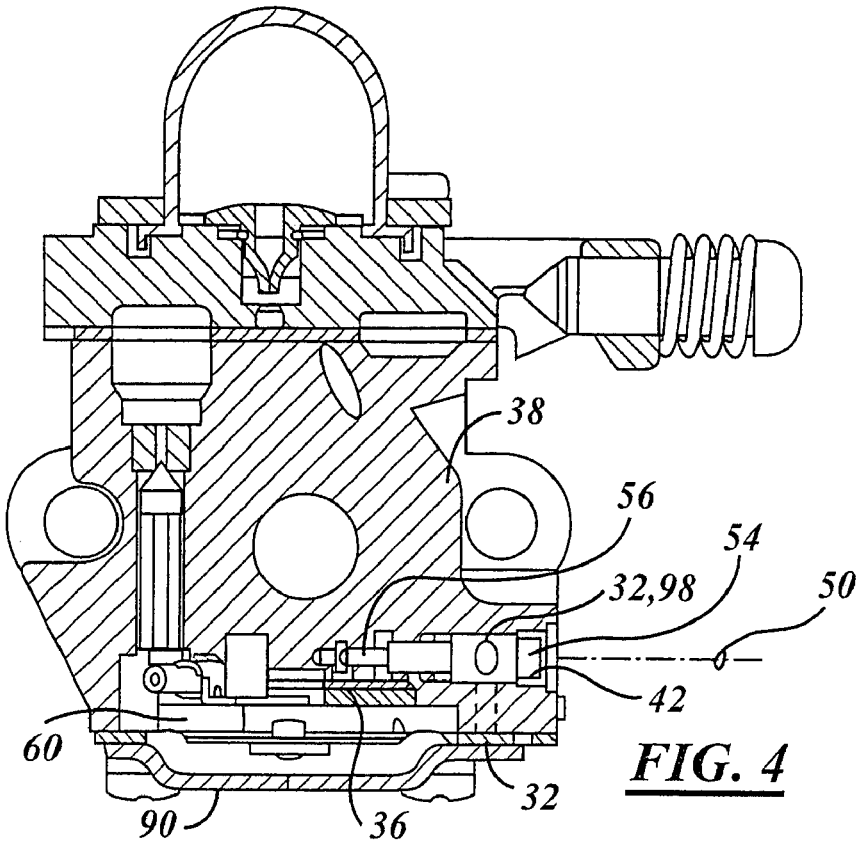
FIG. 4 is a cross section of the carburetor taken generally along line 4—4 of FIG. 3.
Figure 5:
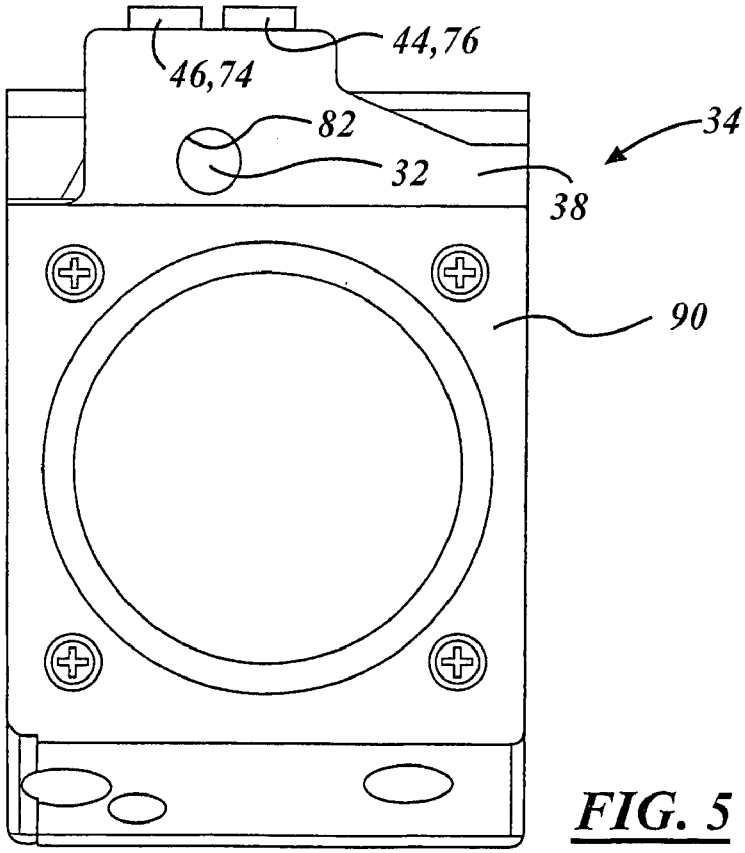
FIG. 5 is a bottom view of the carburetor.
Figure 7:
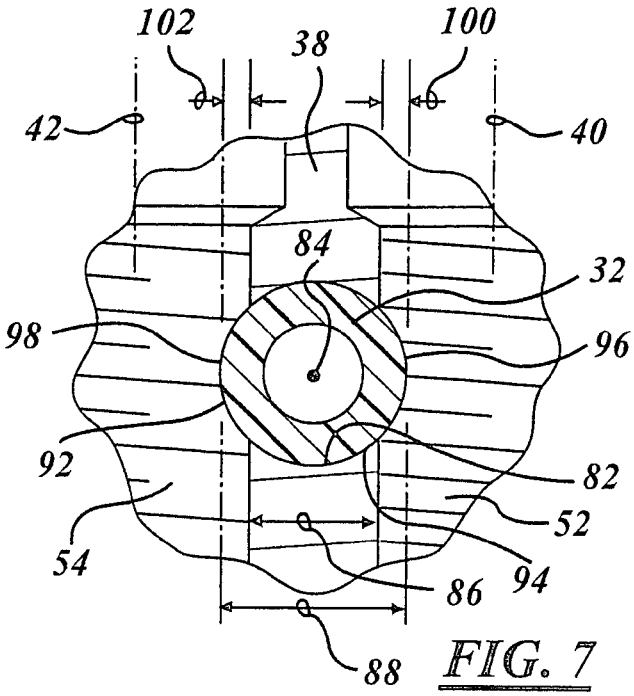
FIG. 7 is an enlarged partial cross section of a portion of the fuel adjustment assembly within circle 7 of FIG. 6.
Figure 12:
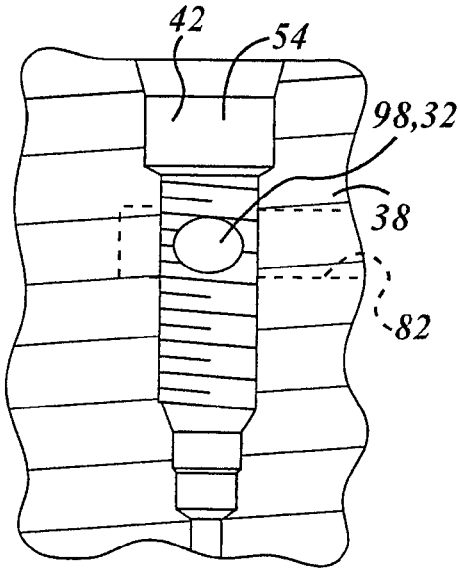
FIG. 12 is a fragmentary view showing a retainer portion of the retainer plug in a carburetor body taken along line 12—12 of FIG. 6.
Figure 11:
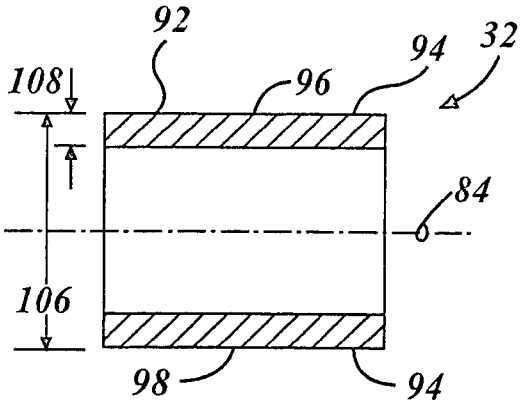
FIG. 11 is a cross section of the retainer sleeve taken along line 11—11 of FIG. 10.

The retainer may be in the form of a sleeve of a resilient plastic material located in a bore 82 of the carburetor body 38 having a centerline 84 which is substantially transverse and preferably perpendicular to and centered between the rotation axis 48, 50 of the low and high-speed needle valves 44, 46 (shown in FIG. 7). The low speed cavity 52 is generally spaced laterally away from the high speed cavity 54 by a first distance 86. Because the centerline 84 of the bore 82 is substantially centered between the rotation axes 48, 50 and the diameter 88 of the bore 82 is greater than the first distance 86, the cavities 52, 54 generally communicate laterally with one-another laterally through the bore 82. The retainer 32 preferably fits snugly into the bore 82 generally through a bottom 90 of the carburetor 34 (shown in FIG. 5). An exterior cylindrical surface 92 of the sleeve 32 has a generally continuous and cylindrical portion 94 which is in tight contact with the carburetor body 38 in the bore 82, and two diametrically opposite and convex portions 96, 98 exposed in the corresponding cavities 52, 54, as best shown in FIGS. 4, 7 and 12.

As best shown in FIG. 7, the first portion 96 generally extends into the first cavity 52 by a first radial distance 100 and the second portion 98 generally extends into the second cavity 54 by a second radial distance 102. The summation of the radial distances 100, 102 and the first distance 86 is generally equal to the diameter 88 of the bore 82. Preferably, the first radial distance 100 is substantially equal to the second radial distance 102 for placing a substantially equal lateral force on the respective low and high speed needle valves 44, 46 creating a substantially equal and consistent torque required to rotate or adjust the needle valves.

Figure 8:
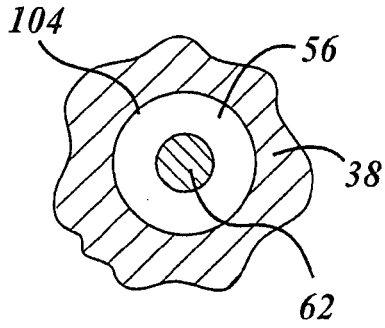
FIG. 8 is a cross section of a fuel orifice and tip of a needle valve of the fuel adjustment assembly taken along line 8—8 of FIG. 6.
Figure 9:
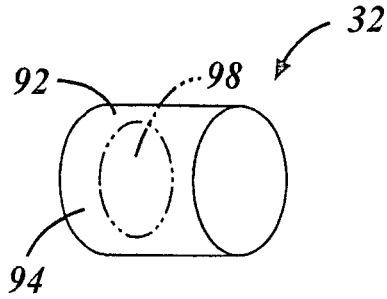
FIG. 9 is a perspective view of a retainer plug of the fuel adjustment assembly.
Figure 10:
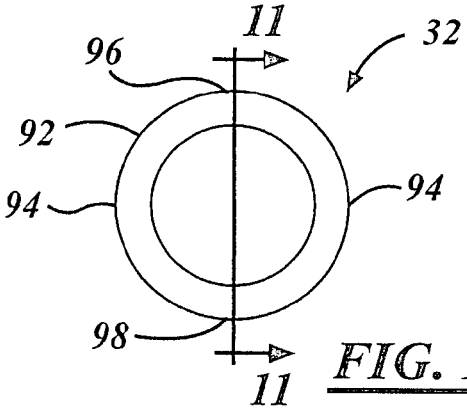
FIG. 10 is an end view of a modified form of a retainer sleeve.

Empirical data has demonstrated that use of the retainer or sleeve 32 will reduce tip 62 wobble by many magnitudes compared to the annular seal 76 alone. Reducing tip 62 wobble or lateral shifting decreases the change in shape and flow area of an annular area 104 between the tip 62 and orifice 56 and thus decreases changes in the carburetor fuel flow characteristics (see FIGS. 4, 6 and 8). Preferably, the retainer or sleeve 32 is axially spaced substantially away from the tip 62 and preferably the seal 76 and is near the head 68. The retainer 32 can be manufactured as a one piece body with a cylinder shape from a resilient material such as nylon, plastic or rubber. In carburetor applications having only one needle valve, the retainer 32 can be either a solid plug or a hollow cylinder or sleeve. In applications that have two needle valves the retainer 32 is preferably a sleeve of resilient material.

As best shown in FIGS. 6–7 and 10–11, utilizing a tube or sleeve 32 rather than a solid plug is preferable when the same retainer 32 stabilizes two needle valves 44, 46 because it reduces the effect of machining tolerances on each needle valve. Given conventional tolerances or clearance between the receptacle 40, 42 and valve shanks 66, the sleeve 32 as tested had 0.008 inches to 0.020 inches of potential interference with each of the valve shanks 66. With a sleeve, each needle valve regardless of the machining tolerance (i.e. centering of centerline 84 between rotation axes 48, 50) only needs to overcome the sleeve wall thickness flexure or yield strength. For instance, utilizing a nylon sleeve having an outer diameter 106 of 0.125 inches and a wall thickness 108 of 0.020 inches and establishing the first radial distance 100 being the minimum 0.008 inch thread to sleeve interference and establishing the second radial distance 102 being the maximum 0.010 inch thread to sleeve interference, both needle valves 44, 46 are shown to require substantially equal torques to achieve rotation.

Customarily, the low and high-speed needle valves 44, 46 of the carburetor 34 are adjusted and set at the factory by the engine manufacturer after the carburetor body 38 is mounted to a running combustion engine, not shown. If the fuel-and-air mixture is too lean, the running engine may overheat causing warranty concerns. If the fuel-and-air mixture is too rich, government regulatory emission requirements may be exceeded or violated. Therefore, limiting adjustment capability by the end user of the engine of the low and high-speed needle vales 44, 46 within an acceptable range is desirable. The engagement of known limiter caps 74 to the heads 68 of the valves 44, 46 establishes the end user adjustment range for fuel flow within the carburetor (i.e. neither too rich nor too lean). The limiter caps 74 are typically press fitted over the heads 68 in the factory after the proper fuel flow settings are made. Without the retainer 32 and after factory adjustment by the engine manufacturer, the press fitting of the limiter caps 74 to the heads 68 of either one or both of the needle valves 44, 46 may move the needle valves 44, 46 axially and/or laterally, causing the factory setting and prescribed adjustment range of the needle valves to be altered or changed.

Empirical data has demonstrated that use of the retainer or sleeve 32 will reduce tip 62 wobble by many magnitudes compared to the annular seal 76 alone. Reducing tip 62 wobble or lateral shifting decreases the change in shape and flow area of an annular area 104 between the tip 62 and orifice 56 and thus decreases changes in the carburetor fuel flow characteristics (see FIGS. 4, 6 and 8).

While the forms of the invention herein disclosed constitute presently preferred embodiments, many others are possible. For instance, the carburetor 34 may have only one needle valve. In this application the retainer 32 may be the solid embodiment as opposed to the sleeve for cost or other considerations. Yet further, it is conceivable that retainer 32 rather than bearing directly upon the male threads 70 of the shank 66, as illustrated, may also bear directly upon a smooth portion of the shank 66 which does not carry male threads. It is also conceivable that in many applications use of the spring 64 will not be required because the retainer will provide sufficient lateral force and axial restraint on the needle valves 44, 46 to prevent unintentional rotation. It is not intended herein to mention all the possible equivalent forms or ramifications of the invention. It is understood that the terms used herein are merely descriptive, rather than limiting, and that various changes may be made without departing form the spirit or scope of the invention.

We claim:

1. A fuel adjustment assembly for a carburetor comprising:

a carburetor body having a needle valve receptacle having a rotation axis;

a fuel passage defined by the body;

a cavity defined by the receptacle and communicating with the fuel passage;

a bore in the body and communicating with the cavity, the bore having a centerline disposed at an angle to and radially spaced from the rotation axis and the bore opening generally radially into only one side of the receptacle;

a hollow retainer of a resilient material fitted into the bore, the retainer having an exterior surface having a portion contacting the carburetor body and a portion projecting into and exposed in the valve receptacle, with the retainer exposed in less than the entire circumference of the valve receptacle; and a needle valve having an elongated shank engaged threadably to the receptacle and a tip, the needle valve displacing a portion of the resilient retainer in the receptacle to frictionally retain and impart a force to laterally bias the needle valve into a steadfast position of the tip relative to the cavity.

2. The fuel adjustment assembly set forth in claim 1 further comprising:

an orifice communicating with the cavity; and the tip of the needle valve projecting axially outward from the elongated shank and into the orifice.

3. The fuel adjustment assembly set forth in claim 2 further comprising:

male threads carried by the elongated shank; and female threads carried by the receptacle and engaged threadably to the male threads, and the retainer being in resilient contact with the male threads.

4. The fuel adjustment assembly set forth in claim 1 wherein the retainer is a sleeve.

5. The fuel adjustment assembly set forth in claim 1 comprising:

the rotation axis, the receptacle, the cavity, and the needle valve being associated with low speed adjustment of the fuel adjustment assembly;

a high speed receptacle of the body defining a high speed cavity communicating with a high speed fuel passage and having a high speed rotation axis;

the centerline of the bore being inclined to and radially spaced from the high speed rotation axis and the bore opening generally radially into only one side of the high speed receptacle;

a second portion of the exterior surface of the resilient retainer projecting into and being exposed in the high speed cavity; and a high speed needle valve having an elongated shank engaged threadably to the high speed receptacle and a tip, and the high speed needle valve displacing a portion of the resilient retainer in the high speed receptacle to frictionally retain and laterally bias the high speed needle valve into a steadfast position of its tip relative to the fuel passage.

6. The fuel adjustment assembly set forth in claim 1 wherein the resilient retainer does not have threads.

7. The fuel adjustment assembly set forth in claim 5 wherein the resilient retainer does not have threads.

8. The fuel adjustment assembly set forth in claim 5 wherein the first and second portions of the exterior cylindrical surface of the resilient retainer have substantially equal areas to one another.

9. The fuel adjustment assembly set forth in claim 8 wherein the first and second portions of the exterior cylindrical surface are co-axial with respect to the centerline of the bore and are disposed diametrically to one another.

10. The fuel adjustment assembly set forth in claim 4 comprising:

the rotation axis, the receptacle, the cavity, and the needle valve being associated with low speed adjustment of the fuel adjustment assembly;

a high speed receptacle of the body defining a high speed cavity communicating with a high speed fuel passage and having a high speed rotation axis;

the centerline of the bore being inclined to and radially spaced from the high speed rotation axis and the bore opening generally radially into only one side of the high speed receptacle;

a second portion of the exterior cylindrical surface of the resilient retainer projecting into and exposed in the high speed cavity; and a high speed needle valve having an elongated shank engaged threadably to the high speed receptacle, and a tip, and the high speed needle valve displacing the second portion of the resilient retainer in the high speed receptacle to frictionally retain and laterally bias the high speed needle valve into a steadfast position of its tip relative to the fuel passage.

11. The fuel adjustment assembly set forth in claim 10 wherein the first and second portions of the exterior cylindrical surface of the retainer are co-axial and disposed diametrically to one another for producing a substantially equal torque between the low and high speed needle valves during rotational adjustment.

12. The fuel adjustment assembly set forth in claim 11 comprising:

the resilient retainer at the first portion projecting radially into the low speed receptacle by a first distance; and the resilient retainer at the second portion projecting radially into the high speed receptacle by a second distance, wherein the first and second distances vary by less than fifty-five percent from one another for producing a substantially equal torque between the low and high speed needle valves during rotational adjustment.

13. The fuel adjustment assembly set forth in claim 12 wherein the resilient retainer is a sleeve made of nylon and having an outer diameter of about 0.125 inches, an inner diameter of about 0.078 inches, the first distance being within a range of about 0.008 inches to 0.020 inches and the second distance being within the range of about 0.008 inches to 0.020 inches.

14. The fuel adjustment assembly set forth in claim 1 wherein the portion of the exterior cylindrical surface of the retainer is convex.

15. A fuel adjustment assembly of a carburetor for adjusting fuel flow to be supplied to a combustion engine, the assembly comprising:

a carburetor body;

two needle valve receptacles formed in the carburetor body, the valve receptacles each having an axis and defining a cavity intersecting a fuel passage formed in the carburetor body;

a pair of needle valves each supported in a separate one of the needle valve receptacles and each including a distal tip, an enlarged head and an exteriorly threaded shank disposed between the tip and head, the threaded shank being in threaded engagement with the needle valve receptacle, the tip being disposable within an axially-aligned orifice portion of the fuel passage, and being axially advanceable and retractable by rotation of the needle valve within its receptacle, to respectively decrease and increase the area of the orifice open to fuel flow;

a bore in the carburetor body communicating with the valve receptacles the bore having a centerline disposed at an angle to and generally radially spaced from the axis of the valve receptacles and the bore opening into only one side of each of the valve receptacles; and a resilient, hollow retainer received in the bore and having an exterior surface projecting into the valve receptacles and engaging and displaced by a portion of and less than the entire circumference of the valve shank to retain and impart a force laterally biasing its tip into one steadfast position relative to the orifice to assure a constant area of fuel flow through the orifice by resisting tip displacement due to such factors as engine vibration and installation of a tamper-resistant limiter cap on the enlarged head.

16. The fuel adjustment assembly set forth in claim 15 wherein the hollow retainer has a cylindrical exterior surface and an inner surface that define a wall thickness with the thickness of the wall permitting the wall to deform against the needle valves.

17. The fuel adjustment assembly set forth in claim 16 wherein the resilient retainer projects into each valve receptacle a radial distance less than the thickness of the wall of the retainer.

18. The fuel adjustment assembly set forth in claim 17 wherein the resilient retainer is in the shape of a sleeve.

19. The fuel adjustment assembly set forth in claim 18 wherein the exterior cylindrical surface is in direct contact with male threads carried by the shank.

20. The fuel adjustment assembly set forth in claim 15 further comprising an annular seal located about the distal tip near the orifice and spaced axially away from the resilient retainer.

21. The fuel adjustment assembly set forth in claim 15 further comprising a compression spring compressed axially between the enlarged head and the carburetor body.

22. The fuel adjustment assembly set forth in claim 15 further comprising an annular seal located about the distal tip near the orifice and spaced axially away from the resilient retainer.

23. A fuel adjustment assembly of a carburetor for adjusting fuel flow to be supplied to a combustion engine, the assembly comprising:

a carburetor body defining at least part of a fuel passage;

a needle valve receptacle formed in the carburetor body, having an axis and defining a cavity intersecting the fuel passage;

a needle valve supported in the needle valve receptacle and including a distal tip, an enlarged head and an exteriorly threaded shank disposed between the tip and head, the threaded shank being in threaded engagement with the needle valve receptacle, the tip being disposable within an axially-aligned orifice portion of the fuel passage, and being axially advanceable and retractable by rotation of the needle valve within the receptacle, to respectively decrease and increase the area of the orifice open to fuel flow;

a bore in the carburetor body communicating with the valve receptacle, the bore having a centerline disposed at an angle to and generally radially spaced from the axis of the valve receptacle and the bore opening into only one side of the valve receptacle; and a resilient, hollow retainer received in the bore and having an inner surface and an exterior surface defining a wall thickness, and wherein the exterior surface projects into the valve receptacle a radial distance less than the thickness of the wall of the retainer so that the exterior surface of the retainer engages, is displaced by and cooperates with a portion of and less than the entire circumference of the valve shank to retain and laterally bias the tip into one steadfast position relative to the orifice by resisting tip displacement due to such factors as engine vibration and installation of a tamper-resistant limiter cap on the enlarged head.

24. The fuel adjustment assembly set forth in claim 23 wherein the resilient retainer is in the shape of a sleeve.

25. The fuel adjustment assembly set forth in claim 24 wherein the exterior cylindrical surface is in direct contact with male threads carried by the shank.

26. A fuel adjustment assembly for a carburetor comprising:

a carburetor body having a threaded needle valve receptacle having a rotation axis;

a fuel passage defined by the body;

a cavity defined by the receptacle and communicating with the fuel passage;

a bore in the body and communicating with the cavity, the bore having a centerline disposed at an angle to and radially spaced from the rotation axis and the bore opening generally radially into only one side of the receptacle;

a cylindrical retainer of a resilient material fitted into the bore, the retainer having an exterior surface having a portion contacting the carburetor body and a portion projecting a radial distance of 0.008 to 0.020 of an inch into and exposed in the valve receptacle, with the retainer exposed in less than the entire circumference of the valve receptacle; and a needle valve having an elongated shank engaged threadably to the receptacle and a tip, the needle valve engaging through only a portion of its circumference the resilient retainer and displacing a portion of the resilient retainer in the receptacle to frictionally retain and impart a force laterally biasing the needle valve into a steadfast position of the tip relative to the cavity to inhibit unintentional movement of the tip due to such factors as engine vibration and any installation of an adjustment limiter cap on the valve.

* * * * *